US005263592A

United States Patent [19]

Dingee, Jr.

[11] Patent Number: 5,263,592

[45] Date of Patent: Nov. 23, 1993

[54] GUN SUPPORT APPARATUS

[76] Inventor: George A. Dingee, Jr., 438 Bayou Wood Cir., Angleton, Tex. 77515

[21] Appl. No.: 848,139

[22] Filed: Mar. 9, 1992

[51] Int. Cl.[5] ..... A47F 7/00

[52] U.S. Cl. ..... 211/64; 211/4; 70/58

[58] Field of Search ..... 211/64, 60.1, 113, 87, 211/4; 248/317, 309.1; 70/58; 224/913

[56] References Cited

U.S. PATENT DOCUMENTS

| | | | |
|---|---|---|---|
| 3,045,832 | 7/1962 | Hibbard | 211/64 |
| 3,664,163 | 5/1972 | Foote | 211/4 X |
| 3,749,348 | 7/1973 | Bartlett | 211/64 X |
| 4,003,228 | 1/1977 | Lievens et al. | 70/58 |
| 4,069,691 | 1/1978 | Simpson | 211/4 X |
| 5,022,536 | 6/1991 | Pierson | 211/4 X |
| 5,095,722 | 3/1992 | Chapmond et al. | 70/58 X |

*Primary Examiner*—Robert W. Gibson, Jr.
*Attorney, Agent, or Firm*—Gunn, Lee & Miller

[57] ABSTRACT

A gun storage apparatus is set forth. In the preferred apparatus aircraft cable is connected with a long screw for anchoring into a wall. That connection is accomplished by an upper eyelet, and there is a second eyelet just below the upper eyelet to support a ring sized to fit around the end of a barrel of a weapon. There is a bottom or terminal portion preferably wrapped in plastic to avoid scuffing on the wooden finish of the weapon. The lower portion is defined by eyelets at the two ends thereof which are spaced by such a distance that the lower portion can be wrapped in an encircling fashion around the stock or receiver of the weapon, preferably passing through the trigger guard and behind the bolt of the weapon, for fastening with the hasp of a lock.

10 Claims, 1 Drawing Sheet

FIG. 1
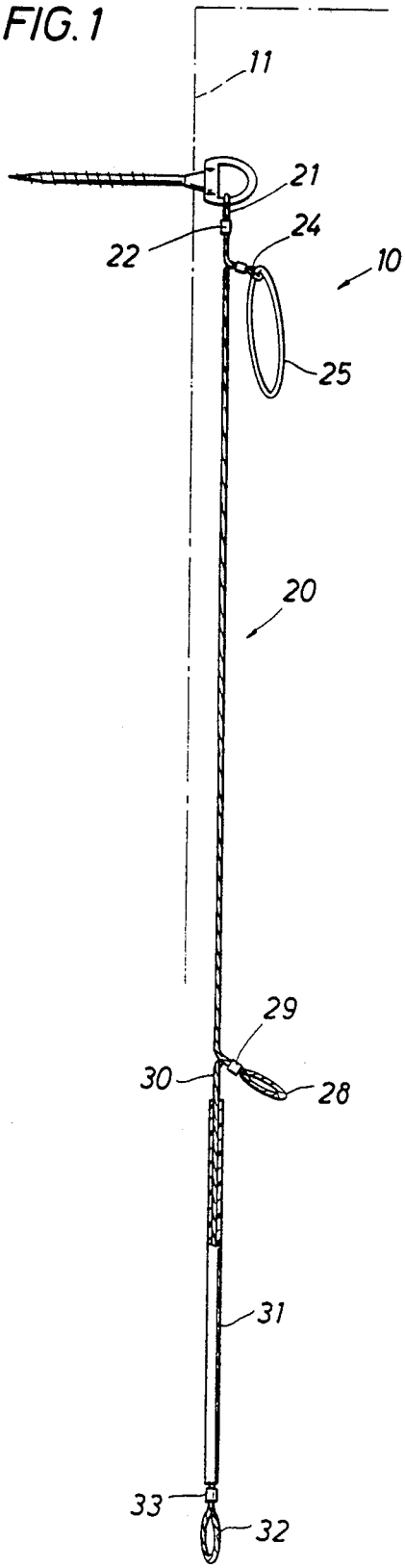
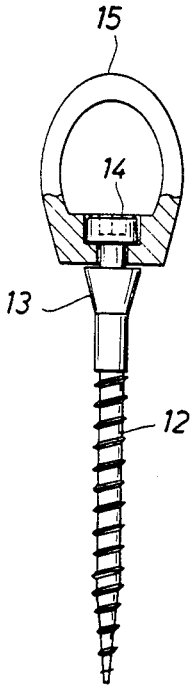
FIG. 2
FIG. 3
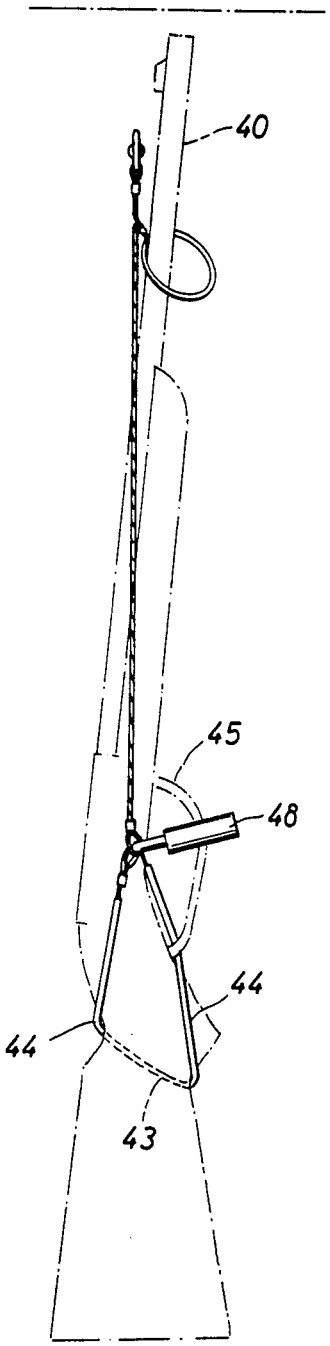

GUN SUPPORT APPARATUS

BACKGROUND OF THE DISCLOSURE

This disclosure sets forth a gun rack of a special sort which is a particularly compact, small and easily installed gun rack which does not otherwise require any floor space. It is a special form of gun rack mechanism which can be installed at the back of a closet or in some basement corner so that the gun is relatively obscure, out of sight, elevated above the floor so that small children may not reach it, and is also installed so that the gun cannot be readily removed.

Most gun racks have the form of furniture, i.e. a large box, cabinet or housing which sets on the floor and holds a number of weapons, perhaps six, perhaps ten or even more. Alternately, some gun racks position weapons horizontally on the wall. Typically, two or three guns will be mounted on the wall on pegs or brackets which support the weapons somewhat in visible display. Typically, this will be used in place of a wall decoration. In either case, the structure is somewhat costly and expensive. Even more importantly, the weapons are often accessible to young children. First of all, they can be readily seen upon entry into a room, and more dangerously, they typically are accessible unless a locking device on a cabinet or the like has been installed. The present apparatus sets forth an entirely different type of gun rack. Rather than feature a large cabinet, box or other housing, the gun rack of this disclosure requires no floor space whatsoever. In a real sense, it requires minimal wall space compared to the common or popular wall mounting brackets. This device by contrast anchors very high on the wall, almost at the ceiling. At that elevation, the weapons in the present gun support are safe and secure from short children which normally excludes the possibility that young children can get their hands on the weapon. Even older children, those tall enough, might reach and touch the weapon held in the present apparatus but they will not be able to point the weapon in any direction except straight up because the weapon is mounted in a position pointed at the ceiling, thus not threatening nearby people.

The present device functions as a very safe gun rack for a single weapon which can be easily installed. Installation requires threading a long screw into the supporting structure, preferably threading through the wall and into the wall stud which holds the screw tightly. Moreover, the device also includes means for aligning the weapon when stored on the rack so that the weapon does not point in a direction creating risk to nearby people. The weapon is pointed by a ring looped around the barrel near the end of the rifle or weapon, thereby fixing the location of the weapon. The upper most point is the point of fastening to the wall stud in a room, typically near a corner. The intermediate point includes the ring, and the lower point connects at, near or with the trigger guard and trigger so that the weapon is held where it can be moved slightly, but cannot be moved through an angle for pointing dangerously. Restated, this enables the weapon to be moved for ease of mounting and dismounting by the present storage device but the weapon is held so that it cannot be leveled in the room and used to threaten another person either willfully or accidentally. Even assuming it were loaded and discharged while held in the present apparatus, it would fire at the ceiling at a corner location which would be much safer than other weapon storage devices.

This apparatus, to summarize, includes an elongate screw having a head for fastening with a flexible member. One form of flexible member is chain while an alternate form is flexible metal cable such as woven wire rope of a diameter typically known as aircraft cable. It is anchored to the screw in a connection permitting pivotal movement. The flexible member supports an eyelet which connects with a large ring, preferably a rigid ring, sized to fit about the barrel of the weapon, both a single barrel and a double barrel weapon. Moreover, the flexible cable has substantial length to define a loop or bight near the lower end sized and proportioned to connect with a lock as will be described. Below that loop, there is a terminal portion or length preferably wrapped in a soft plastic sleeve to prevent scarring and scuffing, and also including a terminal end loop. By appropriate routing of the terminal portion, the loops can be aligned so that a lock can be passed through them to fasten the loops with the hasp of the lock. Moreover, this permits the flexible member to be routed along the length of the weapon so that the lower terminal portion passes along one side of the receiver, over and around the stock at the back end of the bolt, under the stock and back through the trigger guard. This enables the lock to connect by fastening the hasp through appropriate loops and indeed even through the trigger guard if desired.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a view showing the gun mounting mechanism of the present disclosure extending from a long screw suitable for fastening through a wall and further showing an elongate flexible member hanging below the screw which engages the weapon as will be described;

FIG. 2 is an enlarged view of one embodiment of a screw showing a pivotal head on the screw which enables movement of the flexible member such as a chain or cable hanging from the screw; and FIG. 3 is a view showing the gun mounting apparatus further illustrating a weapon and dotted line showing how the weapon is held at the barrel and also at the stock and trigger housing.

DETAILED DESCRIPTION OF THE PREFERRED EMBODIMENT

Attention is now directed to FIG. 1 of the drawings which shows the present apparatus installed. The gun mount apparatus is identified by the numeral 10. It is fastened to a wall 11, preferably extending through the sheet rock or paneling which makes up the exterior of the wall. It even fastens deep into the wall at sufficient length to penetrate and connect with a wall stud to provide a very sure and certain anchor spot. Moreover, this apparatus 10 incorporates a screw shown in FIG. 2 of the drawings, the screw incorporating an elongate tapered screw 12, a head 13, and a cable mount 14. The mount supports a head or loop 15 which can rotate for easy alignment. By forming a starter hole through the wall 11 and preferably into the stud, the screw 12 is then fastened by rotation until it abuts the shoulder at the head so that the screw is tightly held in position. More will be noted concerning the position of the screw on the wall in describing operation of the device.

The gun mount apparatus 10 of this disclosure utilizes an elongate flexible member. The preferred forms of flexible member are either link chain or aircraft cable of a relatively small size. If cable is used, the preferred form of cable is flexible metal cable which is known as aircraft cable which is also formed as a woven wire rope. The dimensions can be larger than perhaps 3/16 inch wire rope, up to about a ¼ inch wire rope. Different sizes can be used but these sizes are preferable. A larger wire rope becomes somewhat stiff and difficult to work; a smaller wire rope might not have the necessary strength to withstand great abuse as might occur in the event of an attempted theft.

This apparatus utilizes a wire rope forming the flexible member 20. At the upper end, the wire rope 20 terminates at an eyelet 21 which is defined by a collar 22 which clamps on the eyelet. The eyelet is connected with the screw shown in FIG. 2 so that the flexible member is firmly anchored at the mounting location. The eyelet serves as the upper or terminal end of the flexible member. Another eyelet 24 is formed just below the terminal eyelet 21. It defines a bight to capture a ring 25. The ring has a diameter enabling the ring to pass over the end of the barrel of the weapon. It has a diameter which is sufficiently large to encircle either a single barrel weapon or a double barrel weapon, typically a side by side shot gun. The ring 25 is typically in the range of about 2 inches in diameter. A larger ring generally is not needed; a smaller ring might have difficulty passing over some weapons. Smaller rings can be used provided they are to be used only with a single barrel weapon such as a 22 caliber rifle or the like. Quite obviously, this is a scale factor which can be varied. An important factor is the location of the ring just below the terminal eyelet 21. This assures that the barrel extends above the screw 12 for reasons which will become more logical on description of the installation.

The flexible cable is formed into another loop or eyelet 28 which is again defined by a typical collar 29. The flexible member, below the loop 28, is then defined as the lower or terminal portion 30. In this area, it is as helpful for cosmetic reasons to wrap the flexible cable in a resilient plastic sleeve 31 to prevent scuffing and scarring when used. Finally, there is a bottom loop 32 which is defined again by the collar 33. The distance between the loops 28 and 32 must be carefully considered in the description following.

Attention is now directed to FIG. 3 of the drawings which shows a weapon 40 held by the present apparatus. Some of the description that will follow is particularly focused on the preferred length of the flexible member. These lengths are tied to the size of the weapon. First of all, it should be noted that the ring 25 has been looped around the barrel of the weapon 40. Moreover, the cable is of sufficient length that, when installed on the weapon, the tip of the barrel extends above the screw 12. This is helpful so that the weapon 40 will prevent a person from attempting to steal the weapon by unthreading the screw 12 from the wall. Unthreading the screw from the wall requires that the screw be rotated perhaps 20 or 30 times for unthreading, obviously depending on the length of the screw, meaning the number of turns required to accomplish unthreading. In one form, the screw is so constructed that the loop 15 is integral and is required to rotate with the screw. If this apparatus is installed in the corner of a room and quite near the ceiling, the weapon 40 would be required to rotate with each turn of the screw, and there is no clearance permitting that. Thus, the apparatus 10 of this invention is installed without a weapon, but after installation, it cannot be removed because the weapon serves as a device preventing sufficient rotation and thereby preventing unthreading. In an alternate form, the screw is headless to prevent rotation with a hand tool such a screw driver or a pair of pliers. In the illustrated form of FIG. 2, the screw has a receptacle for an Allen wrench which can be filled to prevent later rotation by a thief.

The weapon is connected with this apparatus at the rigid ring 25. This ring secures the upper end of the weapon. At the lower end, the terminal portion 30 is positioned so that the loop 28 is approximately even with the trigger guard. The terminal portion and loop 28 is placed on one side or the other of the receiver, somewhat below the bolt of the weapon. The lower portion 30 is then extended below the bolt and beneath the stock and is looped at 43 as shown in FIG. 3 of the drawings so that the portion 43 extends on the backside of the stock, and the flexible member then wraps back around at 44 on the same side of the receiver. The flexible member can optionally be snaked through the trigger guard 45 to locate the eyelet 32 in near proximity to the eyelet 28. A lock 48 having a conventional hasp is then connected by passing the hasp through the eyelets 28 and 32. It is even convenient in many weapons, obviously depending on the depth or throat of the hasp, to fasten the lock through the trigger guard 45.

At this juncture, the installation is made complete. By gravity, the weapon hangs with the barrel pointed upwardly. If located at or quite near the corner of a room, it is practically impossible to rotate the weapon in any particular direction. Even if far from the corner of the room, at most the weapon can only be rotated to a horizontal position immediately abutted against the wall 11. If located where the weapon can be moved to a horizontal position against the wall, it is still almost impossible to load the weapon and then discharge the weapon after loading when installed in the gun support apparatus 10 of this disclosure. For instance, the flexible member can be routed so that bolt action weapons are entangled whereby the bolt can be held down against opening by the flexible member. Routing of the flexible member below the eyelet 28 should be considered. The flexible member is preferably routed through the trigger guard in most weapons. In the event of a double barrel shot gun, this normally will require the flexible member to snake through the trigger guard behind the two triggers but at a location where it emerges on the far side of the receiver so that it is able to pass under the stock when forming a large bight with the terminal portion 30.

The device when installed does not scuff or scar the wood on the stock or the receiver portion of the weapon. The soft, pliable and flexible plastic sleeve 31 is a scuff guard to prevent this. Scarring and scratching by the ring 25 at the upper end of the weapon is also substantially prevented. In summary, the weapon is protected against damage while normally resting in the present apparatus. This flexible type of gun storage apparatus can be installed on the weapon in a matter of just a few seconds. Primarily, the weapon is thrust upwardly so that the tip of the barrel passes through the ring 25, and the lower or terminal portion 30 is then routed in the fashion shown in the drawings and the lock is then attached. That can be done quickly. Differences in scale are readily accommodated in view of the fact that most weapons have approximately the same length. Even so, there might be some weapons which are relatively short; to this end, it is preferable that the ring 25 be spaced from the eyelet 28 by a distance which positions the ring around the barrel even on very short barrel weapons. As a generalization, rifles have sufficient length that this poses no problem, and extremely short barrel shot guns are controlled by law which requires that the barrel have a minimum length. In the event the flexible means is link cable, the eyelets 21, 24, 28 and 32 can be links of the chain having a link opening sufficient for the purpose.

While the foregoing is directed to the preferred embodiment, the scope is determined by the claims which follow.

I claim:

1. A gun storage apparatus which comprises an anchored elongate flexible means having a bight formed therein at the upper end of said flexible means for supporting and affixing a ring, said ring being sized to be looped around the tip of a barrel, and also including a lower terminal portion between a first eyelet and a terminal eyelet at the end of said lower terminal portion, said first eyelet and said terminal eyelet having a diameter sufficient to enable the hasp of a lock to be passed therethrough wherein said lower terminal portion is sized in length to enable said lower terminal portion to encircle a weapon in the vicinity of the trigger and trigger guard of the weapon permitting locking so that a loop is formed around the weapon.

2. The apparatus of claim 1 wherein said ring is up to about 2 inches in diameter.

3. The apparatus of claim 1 wherein said flexible means is formed of woven wire rope and is looped into a bight to define said opening means.

4. The apparatus of claim 1 including a wall mounted fastener means for positioning said flexible means at a wall.

5. The apparatus of claim 4 including an elongate, scuff resistant sleeve around said flexible means for contact against the stock of the weapon.

6. A gun mounting apparatus comprising an elongate flexible cable means connected with a screw, said screw having sufficient length to enable said screw to be anchored into an upstanding wall, and wherein said flexible means supports a ring of sufficient size to pass over the end of a barrel of a rifle, shotgun or similar weapon, and said cable means also has a lower terminal portion; said lower terminal portion being defined at two ends thereof by bights so that said flexible cable means between said bights can be locked to the stock of a weapon having the barrel extending through said ring and is secured by locking to the weapon.

7. The apparatus of claim 6 wherein said cable means includes an upper end bight connected to said screw, a second bight connected to said ring, and an elongate sleeve around said lower terminal portion.

8. The apparatus of claim 7 including a screw head connected to said screw.

9. The apparatus of claim 7 wherein said screw includes a head rotating about said screw.

10. The apparatus of claim 9 wherein said head includes means connecting to said flexible means.

* * * * *